US005666783A

United States Patent [19]

Focke et al.

[11] Patent Number: 5,666,783

[45] Date of Patent: Sep. 16, 1997

[54] APPARATUS FOR PRODUCING PACKS MADE OF THIN PLASTIC FILM

[75] Inventors: Heinz Focke; Oskar Balmer, both of Verden, Germany

[73] Assignee: Focke & Co. (GmbH & Co.), Verden, Germany

[21] Appl. No.: 413,032

[22] Filed: Mar. 28, 1995

[30] Foreign Application Priority Data

Mar. 31, 1994 [DE] Germany ..... 44 11 358.7

[51] Int. Cl.[6] ..... B65B 63/04

[52] U.S. Cl. ..... 53/228; 53/230; 53/389.3; 53/389.4

[58] Field of Search ..... 53/230, 228, 586, 53/389.3, 389.4

[56] References Cited

U.S. PATENT DOCUMENTS

| | | | |
|---|---|---|---|
| 3,982,375 | 9/1976 | Focke | 53/389.4 |
| 4,151,699 | 5/1979 | Focke et al. | 53/528 |
| 4,495,746 | 1/1985 | Focke et al. | 53/389.3 |
| 4,509,314 | 4/1985 | Bozza | 53/586 |
| 5,187,922 | 2/1993 | Mast | 53/586 |
| 5,461,954 | 10/1995 | Boriani et al. | 53/389.4 |

FOREIGN PATENT DOCUMENTS

| | | |
|---|---|---|
| 1169361 | 4/1964 | Germany . |
| 2748541 | 5/1978 | Germany . |
| 3131687 | 3/1983 | Germany . |
| 3340408 | 5/1985 | Germany . |
| 3832533 | 3/1990 | Germany . |
| 3907615 | 9/1990 | Germany . |
| 4225452 | 2/1993 | Germany . |
| 4134646 | 4/1993 | Germany . |
| 4138138 | 4/1993 | Germany . |

*Primary Examiner*—John Sipos
*Assistant Examiner*—Gene L. Kim
*Attorney, Agent, or Firm*—Sughrue, Mion, Zinn, Macpeak & Seas

[57] ABSTRACT

In the production of packs with an outer wrapping of plastic film, a continuous forced guiding of a web of material (13) and the blanks (12) produced therefrom is important. The web of material (13) is fed to a knife roller (20). In the region thereof, the blanks (12) are produced by severing. The web of material (13) or each blank (12) is fed to upright suction belts (25, 26) via a transfer roller (39) with suction bores (42). The suction belts (25, 26) are movable up and down relative to the knife roller (20) and transfer roller (39) for carrying out a change of format.

9 Claims, 6 Drawing Sheets

APPARATUS FOR PRODUCING PACKS MADE OF THIN PLASTIC FILM

BACKGROUND OF THE INVENTION

The invention relates to an apparatus for producing packs made from especially thin plastic film, wherein the blanks can be successively severed from a continuous web of material and fed to a wrapping station in a (vertical) plane and, in the region of the wrapping station, folded around an article in a U-shaped manner, the article being (horizontally) conveyed transversely relative to the plane of the blank, especially around a group of individual packs for forming a bundle, and wherein the blanks can be severed in the region of a knife roller with suction bores, and a counter knife, and the web of material and the blanks can be transported by (upright) lateral suction belts. The packs to be produced are especially bundles made of a plurality of individual packs, in particular soft packs of folded paper tissues. The outer wrapping of such bundles is made from a thin plastic film which, owing to its technological properties, causes problems in the mechanical handling. Moreover, especially in the case of bundles of paper tissues, it is necessary to operate with different sizes of bundles, in particular depending on the number of desired individual packs per bundle.

To adjust the packaging machine to differing formats of bundles it is already known to provide for sets of replacement members which are assigned to the different formats of bundles. The sets of replaceable format-dependent folding members and other members are replaced in the packaging machine when the format is changed. Thereby, other format-independent members, especially a film appliance, are moved upwards to allow the exchange of the replacement sets (DE 41 38 138).

SUMMARY OF THE INVENTION

The invention is based on the object to design a packaging machine in the region where the packaging material is handled in such a manner that a continuous, accurate forced guiding of the web of material and the blanks is ensured, especially in conjunction with an improved possibility of changing formats.

To attain this object, the apparatus according to the invention is characterized in that the web of material, or the blank which is severed therefrom, can be conveyed from the periphery of the knife roller to the periphery of a transfer roller, which is also provided with suction bores, and which feeds the web of material or the blank directly to the suction belts and adjoins them thereto.

In the upper region of the suction belts, which are guided to a small distance from the periphery of the knife rollers, the transfer roller is positioned such that the web of material or the severed blank is conveyed, with a sensible control of the suction air, from the periphery of the knife roller to the periphery of the transfer roller, and from there laterally to the suction belts. The web of material or the blank is thus conveyed without interruption by means of stop faces which are subjected to suction air.

For changing the format, the suction belts, according to the invention, can be lowered as a unit into a lower position and moved upwards into a working position after changing the format. The upward and downward movement of the suction belts is effectuated by a special transmission which ensures an accurate movement, especially in a plurality, for example two stages of motion. In the latter case, one stage of motion is responsible for the fine adjustment of the suction belts in the region of the upper end position.

Further details of the invention relate to the forced guiding of the web of material and the blanks, and to the design of the transmission for adjusting the suction belts. An exemplary embodiment will be described hereinbelow with reference to the drawings. In these

DESCRIPTION OF A PREFERRED EMBODIMENT

Figure 2:
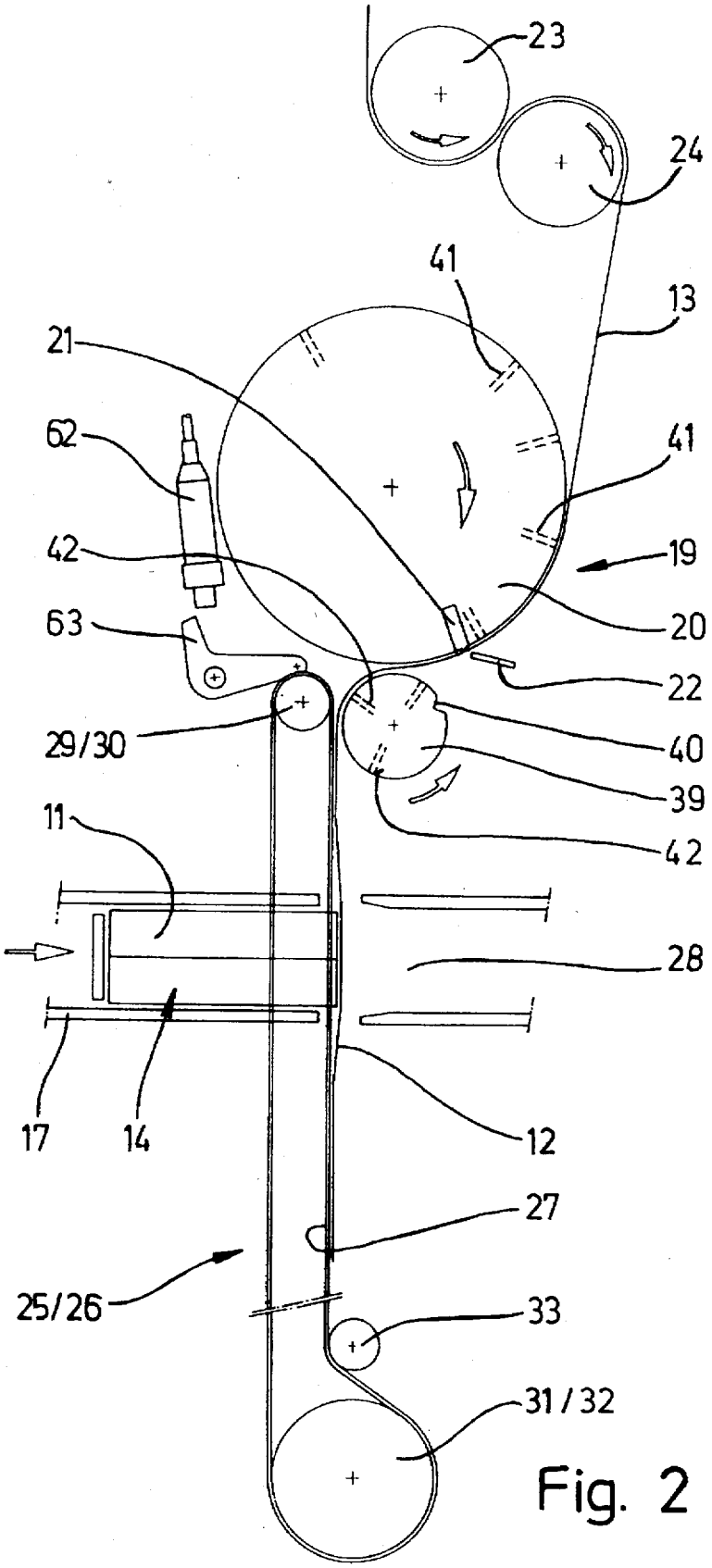
FIG. 2 shows a detail of the packaging machine according to FIG. 1, namely a packaging station, on an enlarged scale, also in a side view.

The mechanical details shown in the drawings belong to a packaging machine for the production of bundles 10, and thus large packs, each consisting of a plurality of small individual packs 11. These packs are preferably packs for paper tissues. Groups of individual packs 11 are wrapped into the blank 12, thereby forming a bundle 10. The blank 12 is severed from a continuous web of material 13 of suitable packaging material, especially a thin plastic film. In the example shown in FIGS. 2 and 3, a pack group 14 to be wrapped is composed of two layers or rows of individual packs 11.

Figure 1:
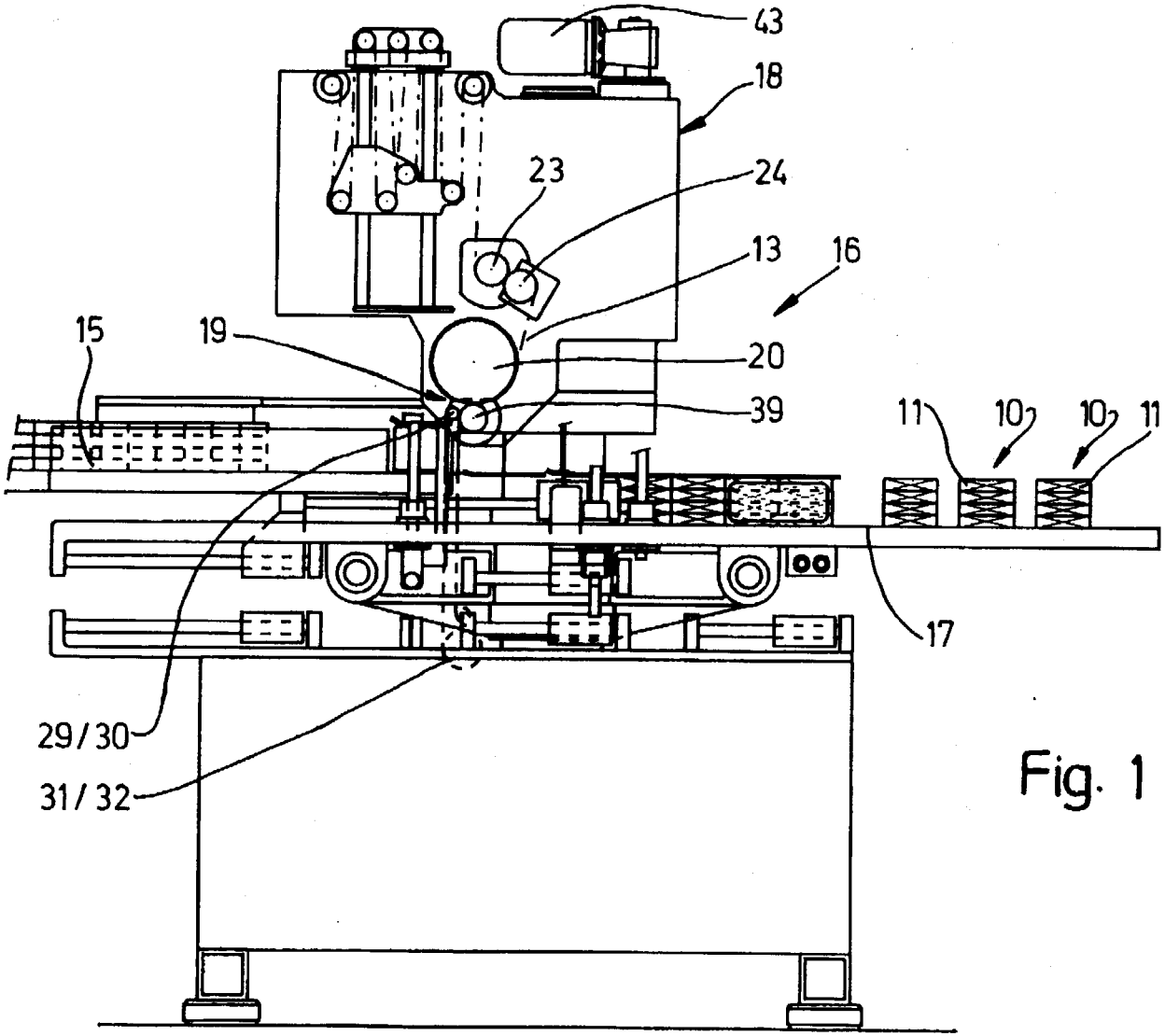
FIG. 1 shows a part section of a packaging machine for bundles, in a simplified side view.

The packaging machine shown in FIG. 1, in its total structure, corresponds to a large extent to the packaging machine according to DE 41 38 138. The individual packs 11 are fed to a packaging station 16 in a plurality of layers on a pack track 15. The content assigned to a bundle 10 is formed by a downward movement of a pack group 14 from the pack track 15 to the plane of a bundle track 17.

In the region of the packaging station 16, a film appliance 18 is located above the bundle track 17. The purpose of the film appliance 18 is to transport the web of material 13 and to feed it to a severing set 19 for producing the blanks 12 by severing them from the web of material. The severing set 19 is comprised of a rotating knife roller 20 with a severing knife 21 protruding from the periphery thereof. The severing knife 21 interacts with a stationary counter knife 22. The web of material 13 is guided to the knife roller 20 by means of a pair of drawing rollers 23, 24. In the shown embodiment, the web of material 13 adjoins the knife roller 20 approximately in the region of one quarter of its peripheral surface.

The web of material 13 and—after carrying out the severing cut—the blank 12 are deflected from the knife roller 20 and fed to upright conveying members. These conveying members are suction belts, in particular two suction belts 25, 26 arranged at a distance from one another. These suction belts are designed in the usual manner so as to be permeable. In the region of a conveying strand 27, the suction belts 25, 26 are subjected to suction air on their rear side, which is generated by elongate suction chambers. The web of material 13, or the blank 12, are grasped and transported by the suction belts 25, 26 at their respective upright lateral edges.

The article to be wrapped, specifically the pack group 14, is transported as a unit on the bundle track 17 transversely relative to the plane of the blank 12, in particular between the two suction belts 25, 26. The blank is grasped by surfaces of the pack group 14 located forward in the transport direction, lifted off by the suction belts 25, 26, and folded around the pack group 14 in a U-shaped manner. The last-named first folding step for the blank 12 results from the insertion of the pack group 14 together with the blank 12 into a mouth piece orifice 28 of the continuing bundle track 17.

At the top, namely adjacent to the knife roller 20, the suction belts 25, 26 are guided on deflecting rollers 29, 30 of a relatively small diameter. At the bottom, the suction belts 25, 26 run on deflecting rolls of larger diameter, namely on drive rollers 31, 32. Supporting rolls effectuate a parallel guide of the strands of the suction belts 25, 26 corresponding to the diameter of the deflecting rollers 29, 30. At the same time, a relatively large belt contact surface with the drive rollers 31, 32 is obtained.

A particularity consists in the fact that the suction belts 25, 26 are sustained or supported exclusively in the lower region. To this end each suction belt 25, 26 is assigned elongate, upright supporting members, specifically supporting arms 34, 35. These supporting arms 34, 35, at their upper ends, form a fork 36 for mounting the deflecting rolls 29, 30. The lower region of the supporting arms 34, 35, which freely project towards the top, is supported in the region of an actuating gear 37. At least an upper region of the supporting arms 34, 35 takes the form of a hollow body for forming suction chambers for the suction belts 25, 26. These suction chambers, which are not shown in detail, extend over the length of the web of material 13 or the blank 12 down to the lower position (edge 38). The suction chambers are connected to a vacuum source which is not shown either.

The suction belts 25, 26, or the deflecting rolls 29, 30 thereof, are arranged at a small distance below the knife roller 20 offset relative to the vertical central plane of the same. An intermediate conveyor, specifically a transfer roller 39, serves for the transfer of the web of material 13, or the blank 12 from the periphery of the knife roller 20 to the conveying strands 27 of the suction belts 25, 26. This transfer roller 30 is arranged exactly below the knife roller 20 in the present case with the axis of rotation being located in the central plane of the knife roller 20. The position of the transfer roller 39 is chosen such that, as a result of correspondingly small distances, the web of material 13 or the blank 12 can be taken over from the periphery of the knife roller 20, and can be transferred to the suction belts 25, 26 after a transport along approximately a quarter of the periphery. For this purpose, the transfer roller 39 is located in the angle formed between the periphery of the knife roller 20 and the conveying strand 27 of the suction belts 25, 26.

The transfer roller 39, on its periphery, is provided with a depression 40 which extends in the longitudinal direction. This depression allows the entry of the severing knife 21 of the knife roller 20 in the coordinated rotating movement of knife roller 20 and transfer roller 39 in a corresponding relative position, without a (further) severing cut being made on the peripheral surface of the transfer roller 39.

The knife roller 20 is provided with suction bores opening on the peripheral surface. The transfer roller 39 is also equipped with radially directed suction bores 42. The suction bores 41, 42 are connected to a vacuum source via suction canals which are known regarding their structure. The suction bores 41, 42 can be controlled in a certain manner regarding the effectiveness of the vacuum. In the region of the knife roller 20, the suction bores 41 which grasp the web of material 13 or the blank 12 are subjected to suction air. This also applies to the suction bores 42 of the transfer roller 39.

The rotational speeds of the knife roller 20 and the transfer roller 39 are adjusted to one another such that the suction bores 41 of the knife roller 20 correspond with suction bores 42 of the transfer roller 39 in the region of the transfer of the web of material 13 or the blank 12, and are thus located coaxially. The suction bores 41 are vented in this position so that the film track is released while the respective suction bores 42 are subjected to suction air in this position. Thereby, a fault-free transfer of the web of material 13 or the blank 12 is ensured. The suction air is controlled in a similar manner during the transfer to the suction belts 25, 26.

The shown apparatus is designed such that a change of format can be effectuated in a very short time without any problems. This applies to the adjustment to pack groups 14 of greater breadth and/or height.

To this end, members which depend on the respective format of the bundle 10, especially folding members, are combined to form a replacement set. The members of the replacement set are located on a common support which can be laterally moved out of the packaging machine, specifically the packaging station, as a unit, just as in DE 41 38 138. For this replacement of the replacement sets, the film appliance 18 can be moved up and down as a unit, specifically first into an upper position for the replacement, and then into the lower working position shown in FIG. 1. The film appliance 18 is movable by means of a motor 43 via a transmission, especially via a spindle drive. In so far, the apparatus corresponds to the one according to DE 41 38 138.

For changing the format, a unit comprising the suction belts 25, 26 is also movable up and down. In a lower position (not shown) are located the upper deflecting rolls 30, preferably below the bundle track 17, so that format-dependent replacements can also be carried out in this region.

The downward and subsequent upward movement of the suction belts required for the change of format is effectuated by the actuating gear 37. This actuating gear 37 takes effect in the region of the drive rollers 31, 32, which are mounted on a common drive shaft 44. The drive shaft 44, in its turn, is moved up and down together with the drive rollers 31, 32.

To this end, the drive shaft 44 is rotatably mounted with its respective ends in a supporting body 45, 46. These, in their turn, are mounted displaceably, specifically slideably, on upright supporting rods 47, 49. The drive of the drive shaft 44 is effectuated via a toothed belt 49 by a motor (not shown).

The drive for the up and downward movement is generated by an upright spindle. This spindle is rotatably driven by a motor 51, which is arranged on the bottom side of a carrier plate 52. The spindle 50 is rotatably mounted on this carrier plate with its lower end. The supporting rod 47 is also fixed to the carrier plate with its lower end. The other supporting rod 47 is fixedly connected to a part of the machine frame (not shown).

The spindle 50 co-operates with a spindle nut 53, which is a part of the unit which is movable up and down. In the present case, the spindle nut 53 is arranged on a transversely directed connecting rod 54. This connecting rod 54 connects the respective two supporting bodies 45 and 46. By actuating the spindle 50, the lateral supporting bodies 45, 46 are consequently moved up and down via the connecting rod 54, and thereby slide along the supporting rods 47, 48.

The lower ends of the supporting arms 34, 35 are connected to this vertically movable unit. To this end, the supporting arms 34, 35 are supported on the drive shaft 44 and additionally on the connecting rod 54.

Figure 3:
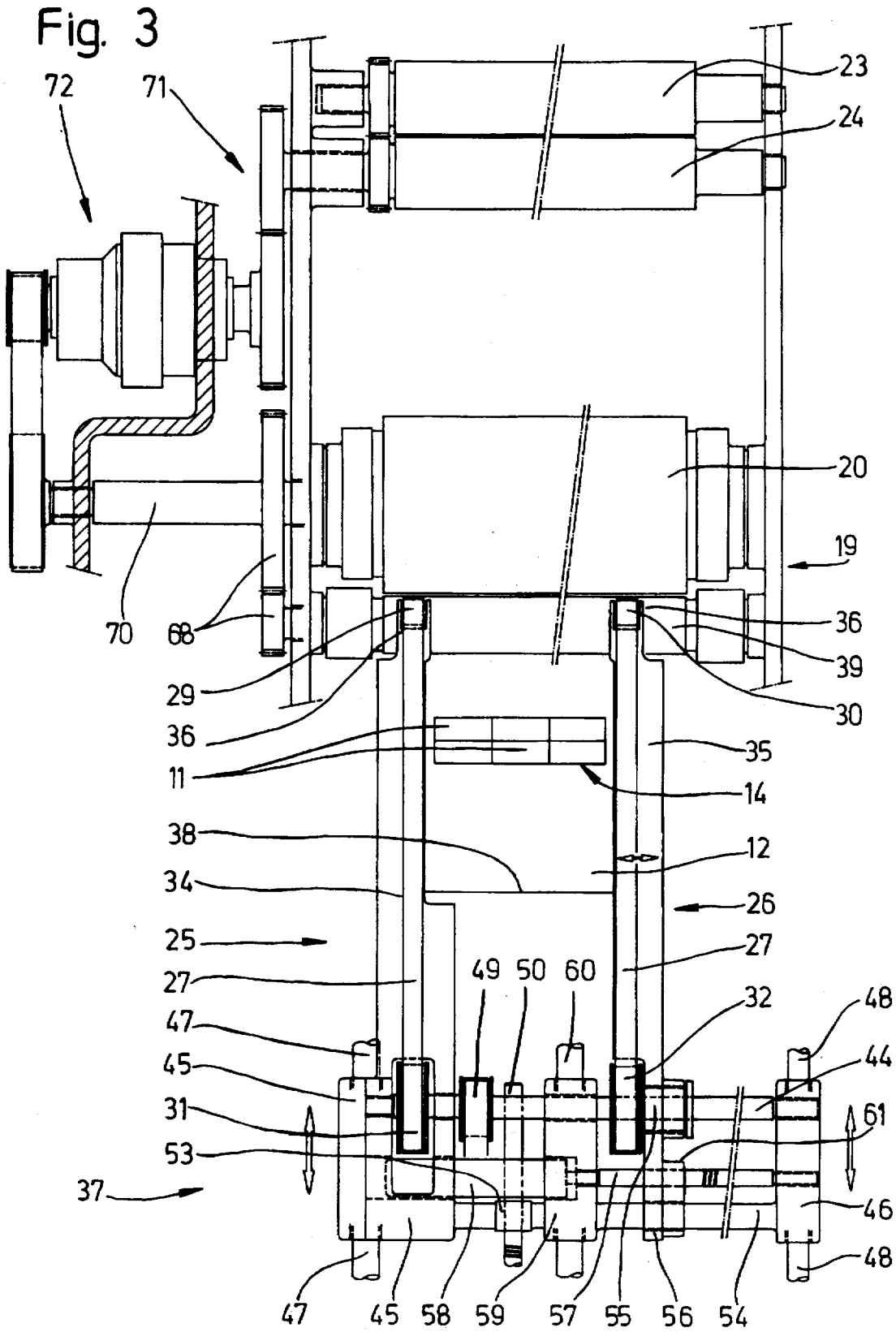
FIG. 3 shows a detail according to FIG. 2 with additional members, in a view offset at 90°.

The supporting arm on the left hand side of FIG. 3 is connected to the supporting body 45 to form a constructive unit. For the adjustment to packs or bundles of different width, on the other hand, the other supporting arm 35 is displaceable in the transverse direction.

To this end, the lower drive roller 32 is provided with a hub 55. This hub 55, with the drive roller 32, is slideably mounted on the drive shaft 44, which is designed as a splined shaft at least in the region of motion of the hub 55 for a positive, non-torsional mounting of the hub 55.

The supporting arm 35 is connected to the hub 55. A lower continuation 56 of the supporting arm 35, which extends beyond the drive shaft 44, is displaceably mounted on the connecting rod 54. A further spindle drive is provided for displacing the drive roll 32 together with hub 55 and supporting arm 35. A horizontally directed spindle 57 is rotatably mounted with one free end in the supporting body 46. The other free end is connected to a horizontally disposed motor 58. This motor 58, on the other hand, is mounted with a free region in a part of the supporting body 45. For further support, the motor 58 and the spindle 57 are mounted in a supporting body 59 which, on its part, is slideably mounted on an upright guide rod 60. This guide rod 60 is also connected to the carrier plate 52. The spindle 57 is passed through the continuation 56 of the suction chamber and engages with a spindle nut 61, which is attached to this continuation 56.

The actuating gear 37 described above thus allows a vertical adjustment of the suction belts 25, 26 for replacing the replacement sets of the packaging machine, on the one hand, and a transverse adjustment of the suction belt 26 for adapting the distance of the suction belts 25, 26 according to the size of the bundles to be produced.

The upward movement of the suction belts 25, 26, after carrying out a change of format, is controlled by members which are connected to the upwardly and downwardly movable film appliance 18. After a change of format, the film appliance 18 is thus first moved downwards into the accurate position corresponding to the size of the bundle. Thereby, the upper final position of the suction belts 25, 26 is also defined, in particular, in the present example, by a switch, specifically a trigger 62 connected to the film appliance 18. This trigger 62 is actuated by a switch member 63 which is designed as an angle lever. A free leg or arm of the switch member 63 is actuated by a suction belt 25 or 26, which is moved upwards, specifically adjusted in a pivoting sense. As a result, a stop signal for the motor 51 is generated and the upward movement is stopped.

To facilitate greater amplitudes of motion of the suction belts 25, 26, a further lifting gear is assigned to the suction belts 25, 26 in the shown exemplary embodiment.

The carrier plate 52 is movable up and down with the members mounted thereon. To this end, a further, upright guide rod 64 is arranged on the carrier plate 52. This guide rod 64, together with the carrier plate 52, the supporting rod 47, and the guide rod 60, forms a supporting frame. The aforementioned rods 47, 60, and 64 are connected to one another at their upper ends by means of an angular cross-piece 65. The supporting frame designed in this manner is connected to a stationary support, namely to a guide body 66. In this guide body 66, the guide rod 64 is slideably supported. The guide body 66 is connected to a part of the machine frame (not shown).

In the present case, an upright rodless lifting cylinder 67, which is fixedly mounted on the machine frame in an upright position, serves for the upward and downward movement of the carrier plate 52 with the members arranged thereon. A journal which laterally projects from the lifting cylinder 67 is connected (indirectly, namely via a lever 69) to the carrier plate 52.

Figure 4:
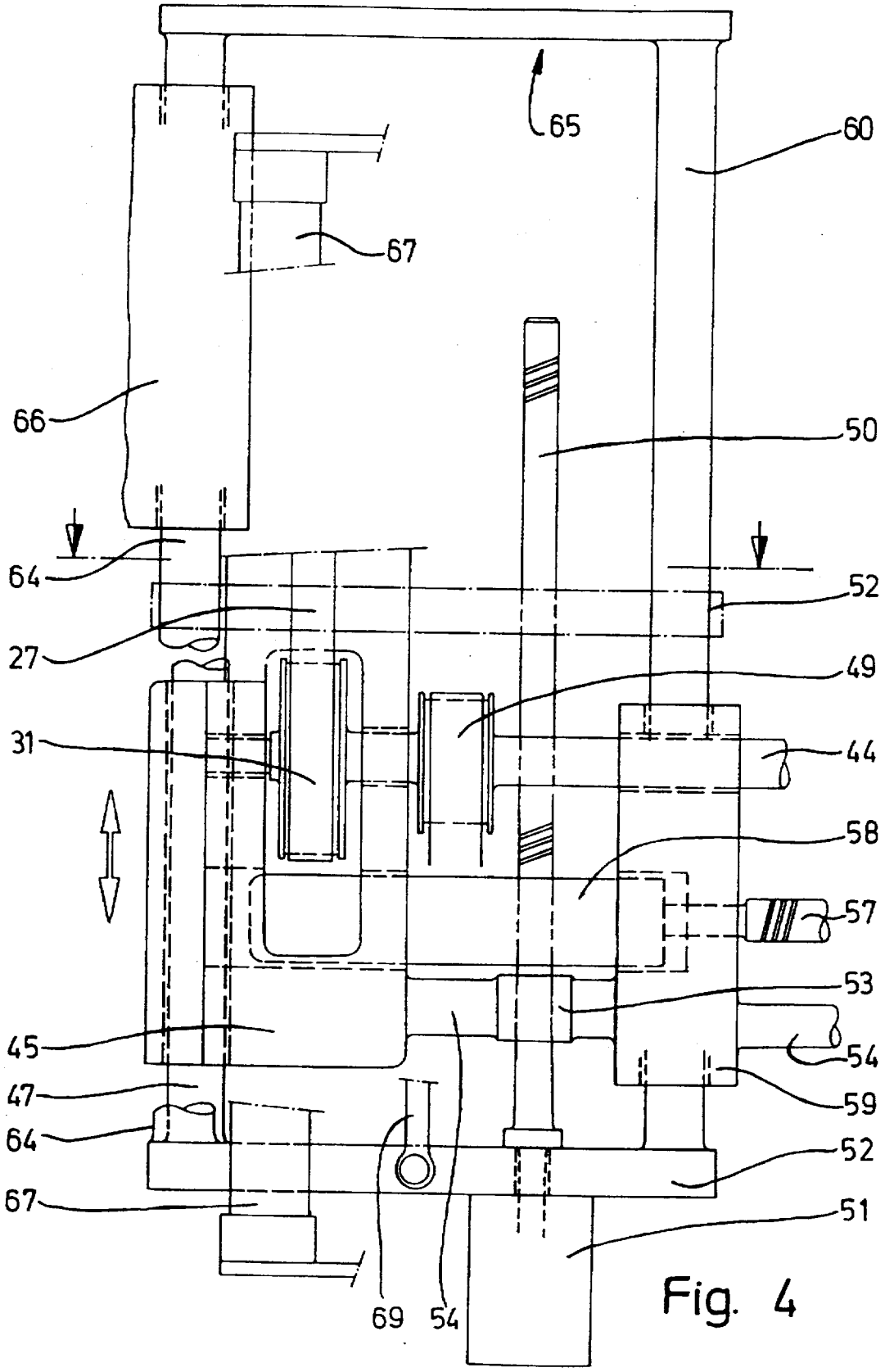
FIG. 4 shows a detail of the transmission for the upward and downward movement of conveying belts or suction belts, on an enlarged scale.
Figure 5:
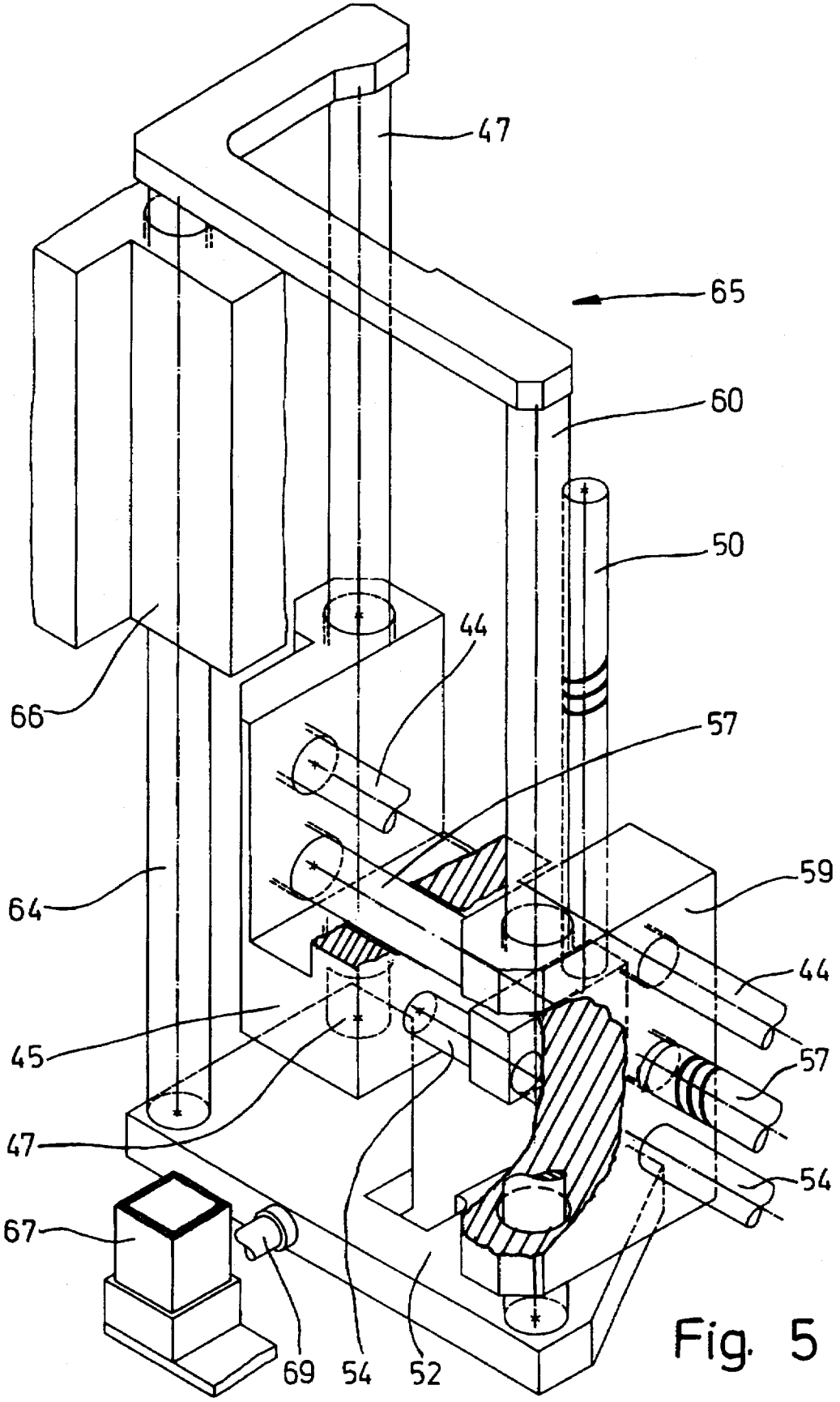
FIG. 5 shows a detail according to FIG. 4 in a perspective view.
Figure 6:
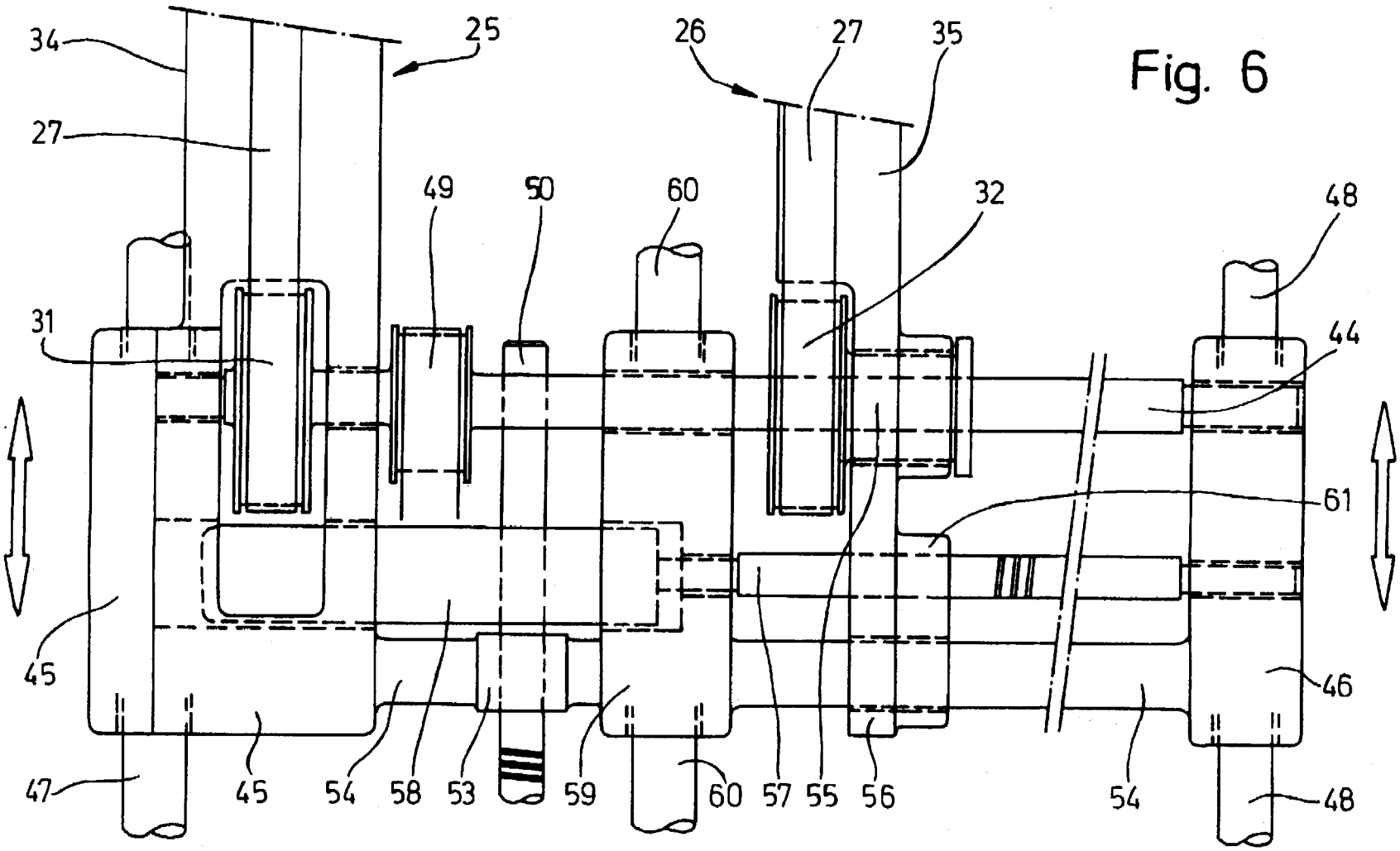
FIG. 6 shows a detail of the transmission according to FIGS. 4 and 5 on a more enlarged scale, in a view according to FIG. 4.

The lifting cylinder 67 is designed in such a manner that a large conveying distance can be covered in a very short time. The upper final position of the carrier plate 52 is shown in dashed lines in FIG. 4. When adjusting the suction belts 25, 26 these are thus first moved downwards by the spindle 50. Then the working movement is continued by the lifting cylinder 67 down to the required lower final position. After the change of format, the lifting cylinder 67 performs a rapid lifting movement. The last section of motion of the suction belts 25, 26, until reaching the upper final position, is effectuated by the spindle 50.

In the present exemplary embodiment there are thus provided two transmissions for the lifting movement of the unit comprising the suction belts 25, 26. Alternatively, an individual lifting gear can be employed in an "overdrive mode" and in a "precision mode" in order to be able to carry out precise movements in a very short time.

The knife roller 20, in the present exemplary embodiment (FIG. 3), is driven by a main shaft 70. The transfer roller 39 is also driven by the main shaft 70 via a gear-wheel transmission. Furthermore, the drawing rollers 23, 24 are connected to the main shaft 70 via a transmission 71. The drawing rollers 23, 24 can be operatively separated from the drive by means of a coupling. In the region of the coupling 72 there is also located a break for retarding or stopping the drawing rollers 23, 24.

What is claimed is:

1. An apparatus for producing packages made from thin plastic film, wherein blanks (12) are successively severed from a moving continuous web (13) of thin plastic film material, are fed to a packaging station (16) in a vertical plane and, in a region of the packaging station (16), are folded around a group of individual packs in a U-shaped manner to form a bundle (10) of packs, the bundle being horizontally conveyed transversely relative to the vertical plane of the blank, said apparatus comprising:

a) a rotating knife roller (20) for severing the blanks (12) from the web (13) at a peripheral surface of said rotating knife roller (20) in a region of a stationary counter knife (22);

b) a plurality of movable vertical suction belts (25, 26) arranged at a distance from one another, and guided by upper deflection rollers (29, 30);

c) a transfer roller (39) for lifting the web (13), and the blanks (12) severed therefrom, off the peripheral surface of the knife roller (20), and for conveying the blanks until they bear against said suction belts (25, 26), d) said suction belts laterally grasping the web (13) or the blanks (12) until a blank (12) is taken over by the bundle (10), e) said knife roller (20) being arranged at a distance from said upper deflection rollers (29, 30) of the suction belts (25, 26), and the transfer roller (39) being positioned between the knife roller (20) and the suction belts (25, 26), f) said transfer roller (39) being positioned between the suction belts (25, 26) and the peripheral surface of the knife roller (20), to form an angle, in such a manner that, for taking over and transferring the web (13) or the blanks (12) to the suction belts (25, 26), the peripheral surface of the transfer roller (39) is disposed immediately adjacent to the peripheral surface of the knife roller (20) and adjacent to the suction belts (25, 26);

g) a plurality of suction bores (41) on said knife roller (20) which open at the peripheral surface of said knife roller for temporarily holding the web (13) and each blank (12) on the peripheral surface of said knife roller (20);

h) a plurality of suction bores (42) on said transfer roller (39) which open at the peripheral surface of said transfer roller (39), and which grasp and convey the web (13) or each blank (12);

i) at least one severing knife (21) which is located at the peripheral surface of the knife roller (20), and which slightly projects from the peripheral surface of said knife roller (20);

j) at least one depression (40) which is located on the peripheral surface of the transfer roller (39), and which is arranged in such a relative position that, when the knife roller (20) and the transfer roller (39) are rotating, the severing knife (21) enters into the depression (40) when the severing knife is in a position opposite the transfer roller (39);

k) means, in the packaging station (16), for transporting each bundle (10) on a horizontal bundle track (17) transversely relative to a blank (12) which is held ready by the suction belts (25, 26), such that the blank (12) folds around the bundle (10) in a U-shaped manner;

l) the suction belts (25, 26) having a first region extending above the bundle track (17), and a second region extending below the bundle track (17), m) the suction belts (25, 26) being guided on the upper deflection rollers (29, 30), above the bundle track (17), and on lower drive rollers (31, 32) below the bundle track (17), n) the upper deflection rollers (29, 30) of the suction belts (25, 26) being positioned in a working position immediately adjacent to the transfer roller (39);

o) located above the bundle track (17), a plurality of replaceable folding members for folding the blanks (12), and which are replaceable by other folding members when there is a change of size of the bundle to be produced;

p) for replacing the replaceable folding members, means for downwardly moving the suction boils (25, 26) as a unit such that the upper deflection rollers (29, 30) of the suction belts (25, 26) are situated in a lower final position below the bundle track (17) or below a path of movement of the replaceable folding members, q) said upper deflect/on rollers (29, 30) being mounted on upright supporting arms (34, 35) of an actuating gear (37) which is movable up and down, and the lower drive rollers (31, 32) forming a pan of the actuating gear (37); and r) means for upwardly moving the suction belts (25, 26) into the working position after the replaceable folding members have been replaced.

2. The apparatus as claimed in claim 1, further comprising:

a) means for driving the knife roller (20) and the transfer roller (39) at mutually corresponding circumferential speeds, b) wherein the suction bores (41) of the knife roller (20) and the suction bores (42) of the transfer roller (39) are disposed equidirectionally at the time of lifting, such that one of the suction bores (41) of the knife roller is located opposite, and aligned with, one of the suction bores (42) of the transfer roller; and c) for the takeover of the web (13) by the transfer roller (39), means for switching off a supply of suction air to the suction bores (41) of the knife roller (20) that are aligned with suction bogs (42) of the transfer roller (39), such that the web (13) or the blank (12) is not held any larger on the peripheral surface of the knife roller (20) by means of suction air in the region of the aligned suction bores.

3. The apparatus as claimed in claim 1, further comprising:

a) a spindle drive for moving the actuating gear (37) and, consequently, the suction belts (25, 26), up and down;

b) an upright, stationary spindle (50) rotationally driven by a motor (51); and c) a spindle nut (53) movable up and down on the spindle (50).

4. The apparatus as claimed in claim 3, further comprising:

a) a common drive shaft (44) to which the lower drive rollers (31, 32) of the suction belts (25, 26) are drivingly mounted in a region of the actuating gear (37); and b) laterally supporting bodies (45, 46) on which the drive shaft (44) is mounted and which are movable up and down for adjusting the suction belts (25, 26).

5. The apparatus as claimed in claim 4, wherein the supporting bodies (45, 46) are connected to one another by a rigid connecting rod (54), and wherein the spindle nut (53) for the upright spindle (50) is connected to said connecting rod (50).

6. The apparatus as claimed in claim 1, further comprising:

a) means for adjusting the suction belts (25, 26) relative to one another in a transverse direction for altering the horizontal distance between one another;

b) means for guiding the suction belts (25, 26) over the upper deflection rollers (29, 30) and over the lower drive rollers (31, 32), c) the lower drive rollers (31, 32) being horizontally displaceable for altering the horizontal distance between the suction belts (25, 26); and d) a common drive shaft (44) on which the lower drive rollers (31, 32) are mounted, at least one of the lower drive rollers (32) being displaceable on the drive shaft (44) in a longitudinal direction thereof.

7. The apparatus as claimed in claim 6, further comprising a horizontally directed spindle (57) with a motor (58), and a spindle nut (61) on the spindle (57), wherein one (26) of the suction belts (25, 26) is displaceable in the horizontal direction by the horizontally directed spindle (57) and the motor (58), said spindle nut (61) being arranged on a supporting extension (56) for said one suction belt.

8. The apparatus as claimed in claim 3, further comprising:

a) two independently effective transmissions for moving the suction belts (25, 26) up and down, b) the actuating gear (37) with said spindle drive ensuring accurate up and down movement of the suction belts (25, 26); and c) a lifting cylinder (67) for moving up and down a unit which consists of the suction belts (25, 26) and the actuating gear (37).

9. The apparatus as claimed in claim 8, wherein:

a) the suction belts (25, 26) and the actuating gear (37) are fixed on supporting rods (47, 48), so as to be movable up and down, which, in turn, are connected to a lower supporting plate (52) and an upper crosspiece (65), b) the supporting rods are connected to a stationary guide body (66) which is fixed on a machine frame, and c) the supporting rods have a guide rod (64) fixed thereto and as is connected to the guide body (66) so as to be movable up and down.

* * * * *